United States Patent [19]

Gazzarrini

[11] Patent Number: 4,576,318

[45] Date of Patent: Mar. 18, 1986

[54] PANTYHOSE CROTCH EDGE STRETCHING APPARATUS AND METHOD

[75] Inventor: Vinicio Gazzarrini, Impruneta, Italy

[73] Assignee: Solis s.r.l., Florence, Italy

[21] Appl. No.: 634,953

[22] Filed: Jul. 27, 1984

[30] Foreign Application Priority Data

Aug. 5, 1983 [IT] Italy ..... 9494 A/83

[51] Int. Cl.[4] ..... D05B 21/00; D05B 35/08; D06C 15/00

[52] U.S. Cl. ..... 223/52; 112/104; 112/121.12; 112/121.15; 223/77

[58] Field of Search ..... 112/104, 121.12, 121.15; 223/52, 75, 76, 77

[56] References Cited

U.S. PATENT DOCUMENTS 4,485,749 12/1984 Gazzarrini ..... 112/104 X
4,485,753 12/1984 Silla ..... 112/104 X

FOREIGN PATENT DOCUMENTS 2415684 8/1979 France .

*Primary Examiner*—Louis K. Rimrodt
*Attorney, Agent, or Firm*—McAulay, Fields, Fisher, Goldstein & Nissen

[57] ABSTRACT

Apparatus and method for removing wrinkles from a pantyhose portion surrounding a crotch area to which a gusset is applied, the pantyhose having a pair of leg portions and a panty portion, which comprises an edge stretcher for stretching the edge portion of the pantyhose surrounding the crotch area, a guide for receiving the pantyhose from a feeding mechanism and transferring the pantyhose to the edge stretcher which includes a receiver for receiving the pantyhose, a holder for holding the leg portions in a fixed position, then moving the receiver to move the panty portion towards a hollow head associated with a gusset sewing machine for moving the panty portion into the hollow head, and suction devices which cooperate with the holder for maintaining the pantyhose portion surrounding the crotch area stretched on the hollow head, the legs being held stretched by pincers, and then the legs are sucked by suction from the receiver into the hollow head.

20 Claims, 9 Drawing Figures

PANTYHOSE CROTCH EDGE STRETCHING APPARATUS AND METHOD

BACKGROUND OF THE INVENTION

1. Field of the Invention

This invention is concerned with an apparatus and method for removing wrinkles from a pantyhose portion to which a gusset is to be applied.

The invention is further concerned with a device for stretching the edge or perimeter of the crotch area of a panty portion of a pantyhose in which a gusset is to be sewn to the edge or perimeter of the panty portion between the leg portions.

More particularly, the present invention is concerned with an apparatus and method to be used in connection with a gusset sewing machine and an automatic feeding mechanism associated with the aforesaid gusset sewing machine for feeding the gusset to the pantyhose so that the gusset can be sewn to the edges of the panty portion between the legs of the pantyhose.

2. Description of the Prior Art

Prior to the present invention, there has been disclosed in published Italian Patent Application No. 9391 A/82 a gusset-sewing machine for pantyhoses, by the same assignee which corresponds to U.S. patent application No. 535,854, filed Sept. 26, 1983 by the inventor of the subject matter of this application, the subject matter of which is incorporated herein by reference.

The gusset-sewing machine is provided with an automated feed and comprises a first pneumatic suction device to stretch the panty portion of the pantyhose lengthwise and vertically under a hollow head which supports the pantyhose garment by the edge thereof which is to be sewn to the gusset and subsequently brings the stretched panty close to the head, but without suction from a suction device reaching its inlet, while the panty is drawn into the head; and two further vertically disposed pneumatic suction devices are placed at the sides of the first suction device in order to stretch the legs of the pantyhose lengthwise, and separately from the panty and before the legs are drawn into the head, immediately after the panty is drawn into the head.

Experience has shown that with some types of fabric, especially in pantyhoses with leg portions of considerable length and fineness, wrinkles sometimes form in the edge to be sewn to the gusset, after the garment has left the first suction device. Furthermore, the drawing of the garment into the head is discontinuous and is slowed down.

SUMMARY OF THE INVENTION

It is a primary purpose of the present invention to provide an improvement over the aforesaid automated feed.

A further object of the invention is to assist in the prevention of the formation of wrinkles in the area of the pantyhose to which the gusset is to be attached to the pantyhose.

A further purpose of the invention is to reduce the time required to transfer the garment from the feed mechanism and properly to position it inside the head of the gusset-sewing machine. These results are achieved according to the invention by adopting the concept of using suction to collect the panty portion and the legs of the pantyhose in a single tube which is vertically placed under the head while the pantyhose is held hanging from the head, then bringing the vertical tube close, until it touches with its upper end the inlet of the head, filling and holding therein the interposed fabric, and finally drawing the panty portion and subsequently the legs into the head. This is assisted by means to guide the pantyhose, while the pantyhose is still hanging from the feed mechanism, and bringing it closer to the inlet of the vertical collecting tube, and by means to facilitate the suction or drawing of the pantyhose from the collecting tube into the head by increasing the suction.

The advantages obtained with the present invention are that it is possible to transfer the pantyhose onto the gusset-sewing machine without forming wrinkles in the area of fabric in contact with the head; and this is to be accomplished with any fabric length and fineness. Further, a much higher transfer speed is obtained than has been heretofore reached in transferring the pantyhose onto the gusset-sewing machine; and, a very high accuracy and reliability of operation is obtained even over very long periods of time.

The invention provides for a wrinkle removing apparatus which includes a stretching device to stretch the edge of the pantyhose to which a gusset is to be sewn by a gusset-sewing machine with automated feed; and the stretching device essentially comprises a vertical tube coaxially movable in a position beneath the head until it reaches the inlet thereof, then an internal sleeve which is movable and contained within the vertical tube projects outwardly from the top of the vertical tube, so that the internal sleeve can enter the inlet in the head for filling in and holding the interposed fabric in the head. To assist in this operation, a guide device which includes a basket is positioned to the side of the vertical tube; the basket has an open top portion and is provided with a V-shaped plan profile having an open front portion, and the guide device also includes a sickle-shaped lever which is located on top of the basket and is operated in an alternating horizontal motion to guide the leg portions of the pantyhose into the vertical tube.

The vertical tube is provided with downward-acting pneumatic suction devices and with pincer devices to suck the leg portions into the tube and hold them with the pincer devices. A port is provided on the vertical tube in a position lower than the base of the vertically movable internal sleeve, and when the internal sleeve is raised the port can be opened and closed by a conventional mechanism to aid in the suction withdrawal of the leg portions from the tube and into the hollow head.

The sleeve is interchangeable and adjustable with reference to the vertical tube.

BRIEF DESCRIPTION OF THE DRAWINGS

In order that the invention will be more clearly understood, reference will now be made to the accompanying drawings which illustrate the best mode presently contemplated for carrying out the invention.

DESCRIPTION OF THE PREFERRED EMBODIMENTS

Referring now more particularly to the accompanying drawings, which illustrate the presently preferred mode and best mode known to me for carrying out the invention. The wrinkle removing apparatus comprises a stretching device and a fabric guide device. The stretching device is used to stretch the edge of the pantyhose at the crotch portion thereof to which the gusset is to be sewn to form a pantyhose with a gusset sewn thereto at the crotch portion. The gusset-sewing machine is of the type with automatic feed.

Figure 1:
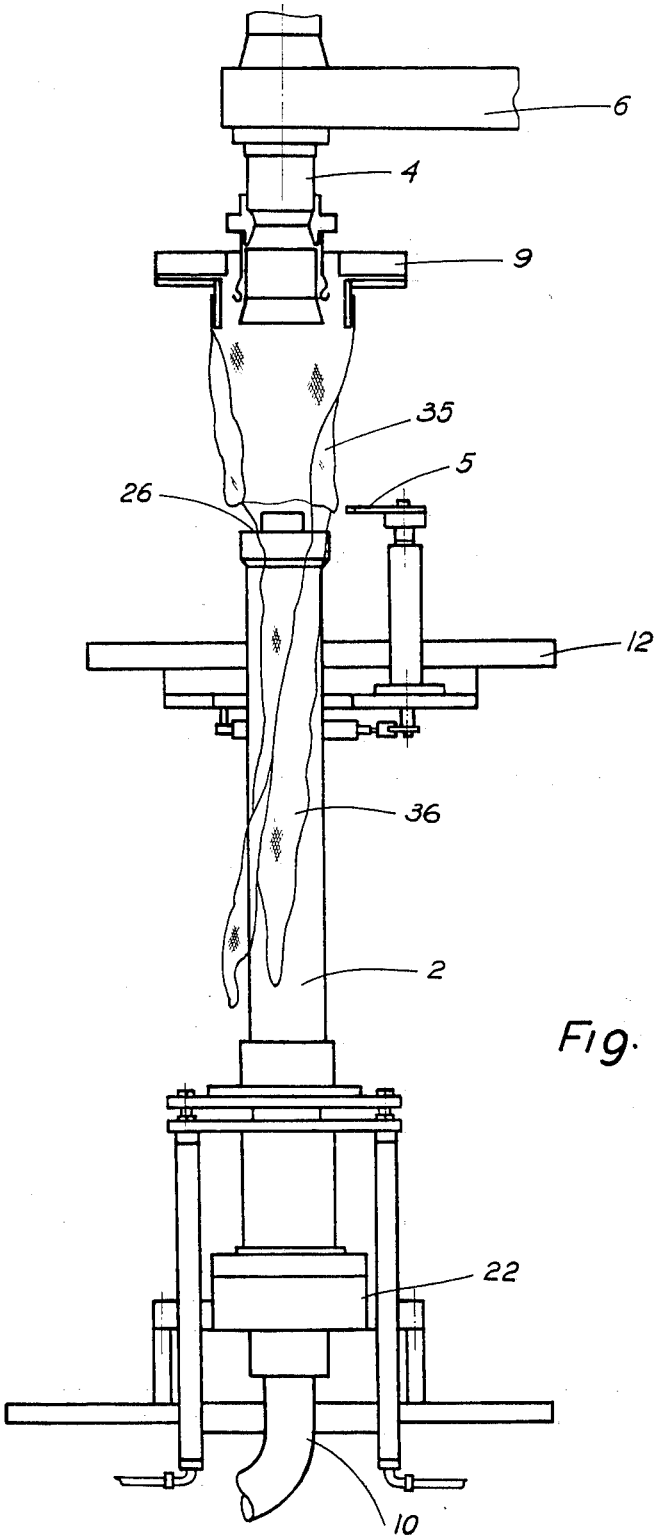
FIG. 1 is a schematic vertical view of the invention and shows an overall side view of a stretching and guide device according to the invention in its inactive state while the pantyhose is held hanging beneath the head from the feed mechanism of the gusset-sewing machine.
Figure 9:
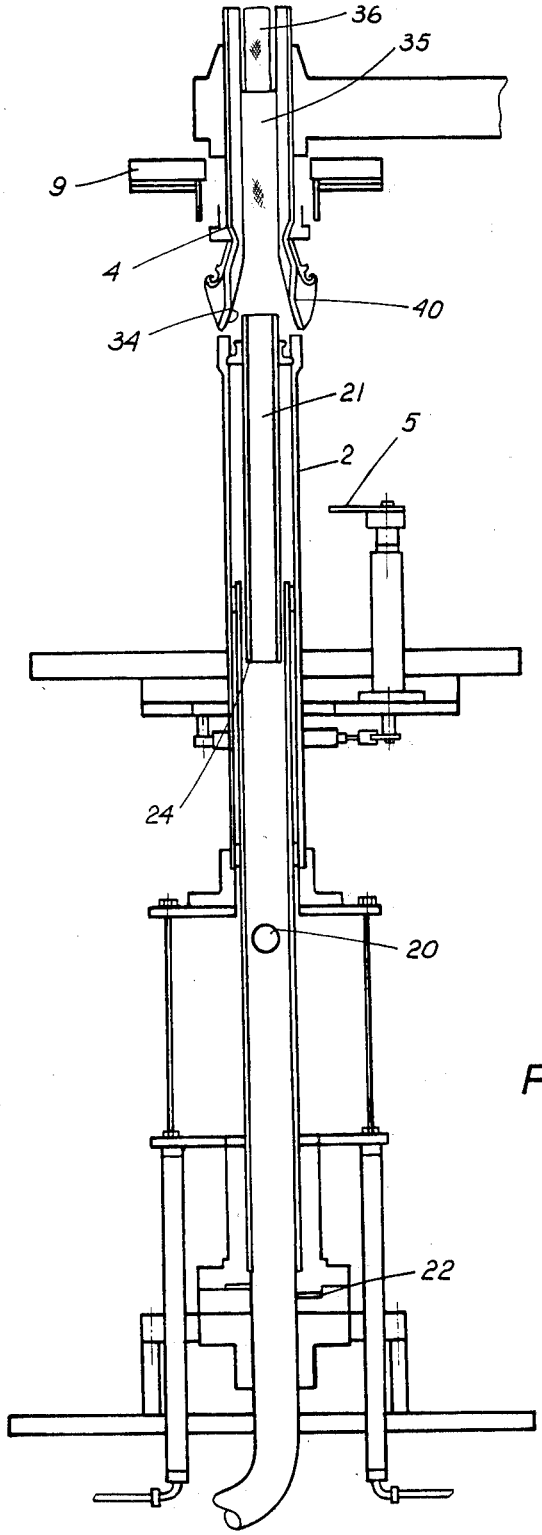
FIG. 9 shows an overall side view similar to FIG. 1 in its final operative or last active state, of the stretching device portion of the apparatus shown in FIG. 7, with the panty portion and legs of the pantyhose moved from its aforesaid position and drawn into the head of the gusset-sewing machine.

The stretching device generally comprises a vertically moving collection tube 2 (see FIG. 1), positioning beneath a hollow head 4 of a gusset sewing machine 6 schematically shown. The gusset-sewing machine 6 forms no part of this invention other than to have the stretching device of the wrinkle removing apparatus to cooperate therewith and to have vertical tube 2 and hollow head 4 coaxially aligned and positioned for all vertical movements of tube 2. Tube 2 moves in a vertical direction towards head 4 until it reaches the position shown in FIG. 9.

Figure 3:
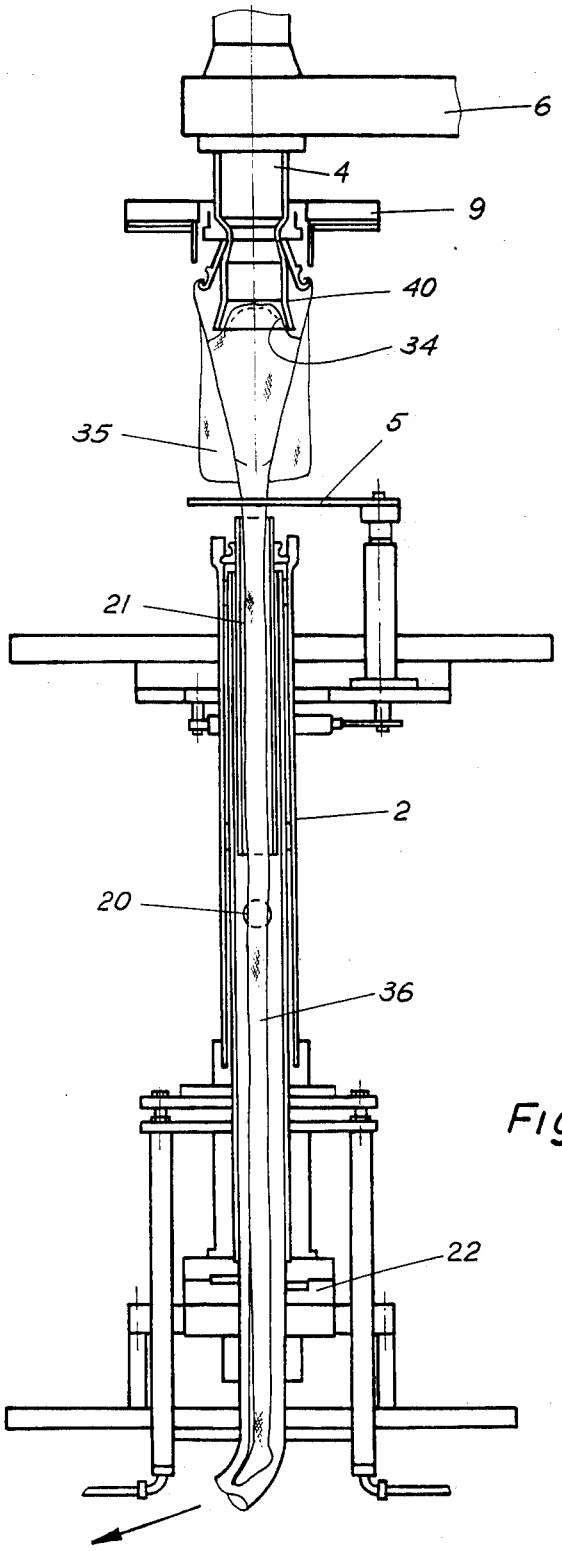
FIG. 3 is a schematic vertical view similar to that shown in FIG. 1, illustrating an overall side view of the stretching and guide devices shown in FIG. 1 in one of its active states, with the vertical collecting tube lowered and suction in progress inside the vertical tube to collect and draw the legs of the pantyhose thereinto, while the pantyhose panty is hanging from the head of the gusset-sewing machine.
Figure 5:
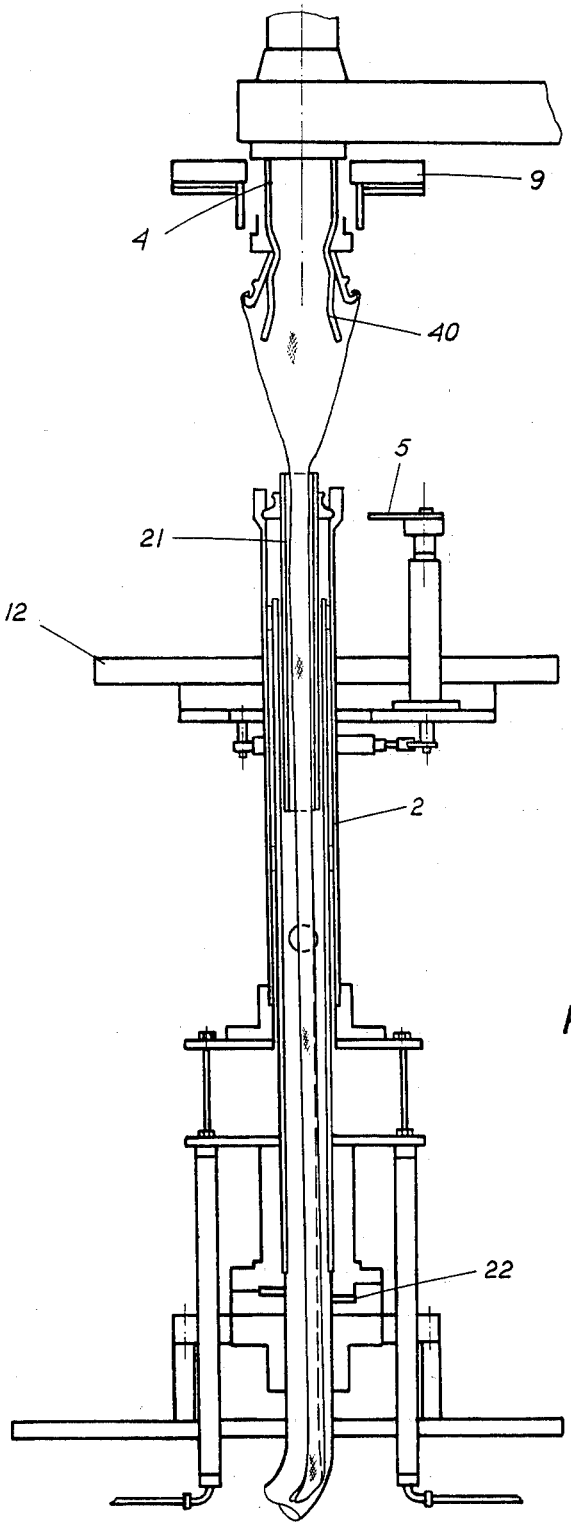
FIG. 5 shows an overall side view similar to FIG. 1 of stretching and guide devices shown in FIG. 3, in another operative or active state with the collecting tube approaching or moving towards the head of the gusset-sewing machine from the position shown in FIG. 3.
Figure 7:
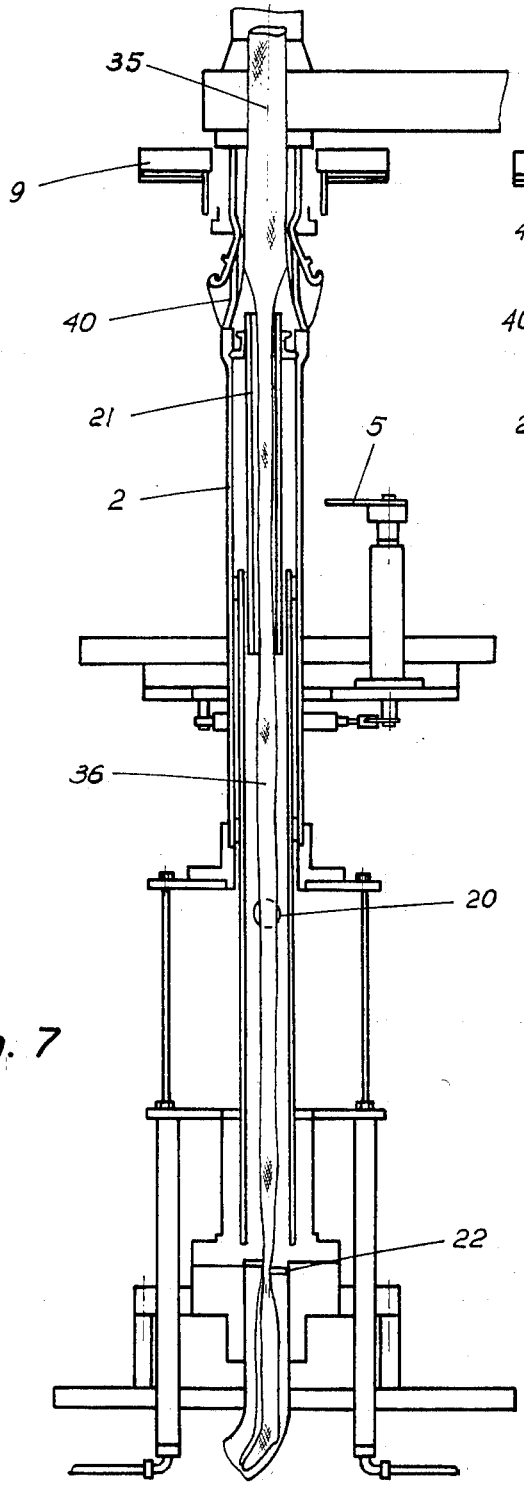
FIG. 7 shows an overall side view of the stretching and guiding devices of FIG. 3 in another operative or active state with the vertical collecting tube at the end of its upward run, and the suction inside the vertical tube being rendered inactive, with the legs of the pantyhose seized and the suction in the head of the gusset-sewing machine placed into operation.
Figure 8:
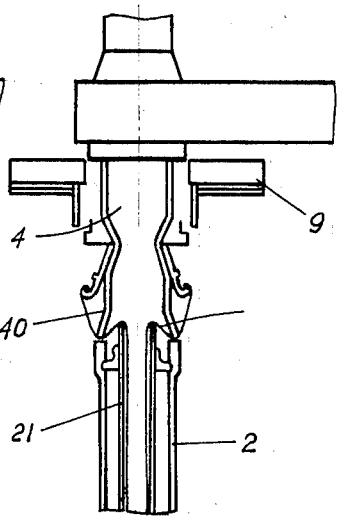
FIG. 8 shows a partial side view of the part which fills and holds the fabric interposed in the inlet of the head.

Vertical tube 2 is equipped with downward acting pneumatic suction devices 10 and with pincers schematically shown as pincer means 22 for holding the legs 36 of the pantyhose as shown in FIG. 7. Inside the tube 2 there is an adjustable and interchangeable sleeve 21 (see FIGS. 3 and 5), projecting from the inlet of tube 2, the purpose of which is to reduce the section containing the pantyhose while at the same time increasing the velocity of the air drawn into it, and also to penetrate (see FIG. 9), with its upper end, the inlet 40 of the hollow head 4, thereby filling in the interposed fabric 34 and holding it.

In order to facilitate the suction of the pantyhose from the sleeve 21 into the hollow head 4, a port 20 is provided on the surface of the tube 2 at a height lower than the base or end of the sleeve 21 when the latter is raised. Port 20 is opened, by known or conventional means, as soon as the suction starts in the head 4, and air is drawn through the port into tube 2 to aid removal of the leg portions therefrom.

In order to guide the legs 36 and panty portion 35 of the pantyhose into vertically movable collecting tube 2, a guide device generally comprising a basket 3 and a curved or sickle-shaped lever is provided.

Basket 3 has a V-shaped plan profile and is attached by conventional means 12 to the side of the collecting tube 2, in the narrower part 14 of which the legs 36 and the panty 35 of the pantyhose are automatically collected.

Figure 6:
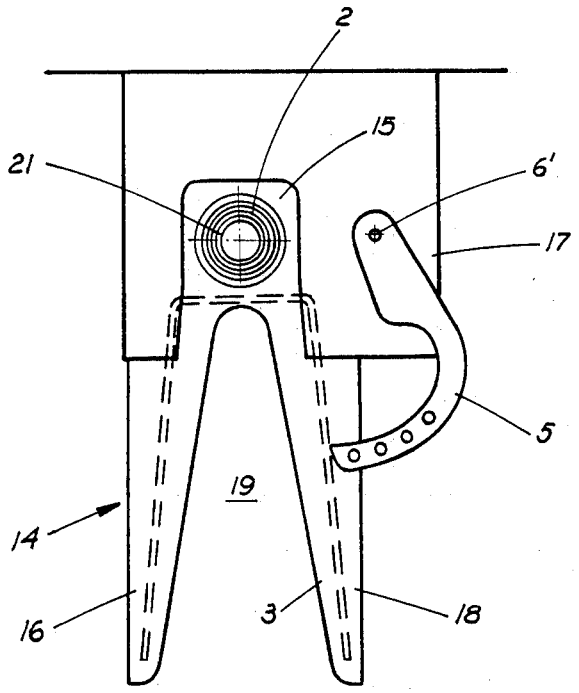
FIG. 6 is a schematic plan view of the guide device shown in FIG. 5, with the curved or sickle-shaped lever which guides the pantyhose onto the inlet of the collecting tube in its inactive or rest position.

Basket 3 generally includes the narrower part 14 formed of a generally V- or U-shaped member having fingers 16, 18 between which the leg portions 36 and the panty portion 35 are picked up and aligned prior to being fed into opening 26 at the top of collecting tube 2. The base 15 of the basket 3 from which fingers 16, 18 extend is coupled with the outer portion of tube 3, and a plate 17 extends from base 15 to which lever 5 is pivoted on pivot 6' to move from a position to the right of fingers 16, 18 as shown in FIG. 6 to a position over opening 26 at the top of tube 2 too place the panty portion 35 and legs 36 over opening 26 for drawing thereof by suction into vertical tube 2. The lever moves past the area 19 between fingers 16, 18 in a single sweep.

The sickle-shaped lever 5 is operated by known or conventional means, with an alternating horizontal motion at the top of the basket 3, for the purpose of moving and guiding in a single run both the legs and panty of the pantyhose above the inlet 26 of tube 2, thereby facilitating the suction inside it.

In order to stretch the edge of a pantyhose to be sewn, which edge is to be sewn to the gusset in a gusset-sewing machine provided with automated feed, the vertical tube 2 is movable coaxially under the head 4 which tube is specially designed to collect and stretch the panty portion 35 and the legs 36 of the pantyhose held hanging from the head 4 by means of vertically downward suction. Subsequently, in order to bring the panty portion 35 thus stretched as far as the inlet 40 of head 4, the sleeve 21 which is enclosed in tube 2 and projects above tube 2 makes it possible to place, fill and hold the interposed fabric 34 into the inlet 40 and pincers 22 make it possible to hold the legs 36 in the tube 2 while the panty portion 35 is drawn into the head 4. Basket 3 which is provided with a horizontal V profile is positioned to the side of the tube 2, to collect the panty portion 35 and the legs 36 of the pantyhose, hanging from feed mechanism 9 for feeding the pantyhose to the head of the gusset sewing machine.

Figure 2:
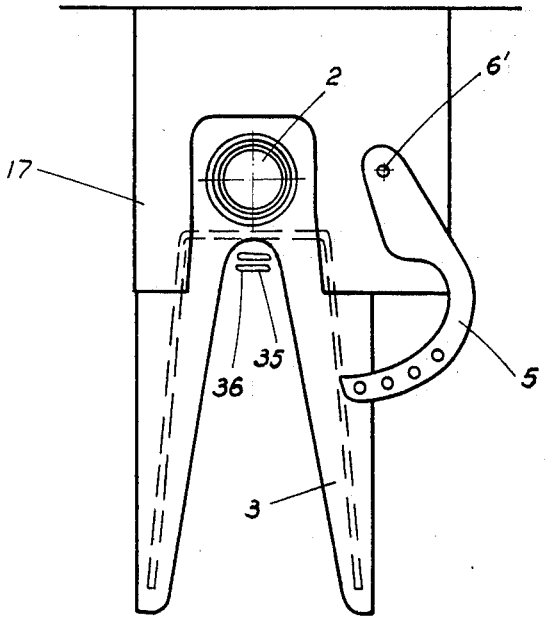
FIG. 2 is a schematic plan view of the guide device in its inactive state in FIG. 1.
Figure 4:
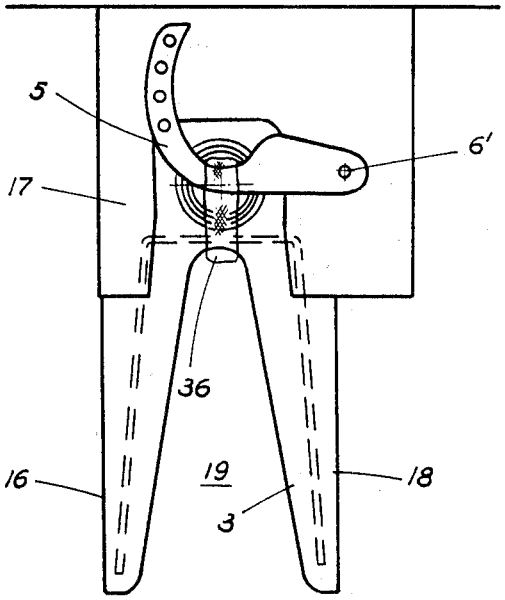
FIG. 4 is another plan view of the guide device shown in FIG. 2 with a curved or sickle-shaped lever which guides the hanging portions of the pantyhose onto the inlet of the vertical collecting tube in operation or its active state.

The sickle-shaped lever machine which is provided with alternating horizontal motion in a plane on top of the basket 3 guides the legs 36 and the panty portion 35 of the pantyhose from the basket 3 onto the inlet 26 of the tube 2 (see FIGS. 2 and 4) while they are drawn into the tube 2.

DESCRIPTION OF THE OPERATION

The feed mechanism 9 carries the pantyhose hanging from itself, and when the feed mechanism 9 is positioned coaxially around the head 4 of the gusset-sewing machine, the legs 36 and the panty portion 35 of the pantyhose are placed into the basket 3. The lever 5 then moves them onto the inlet 26 of the tube 2 and then panty portion and legs are drawn through the sleeve 21 into the tube 2. Subsequently, tube 2 rises towards head 4 while the legs 36 are held by pincers 22 and the panty portion 35 is drawn into the head 4 when the top of the tube 2 reaches the inlet 40 of the head 4, the top of the sleeve 21 fills in the interposed fabric 34 and hold fabric 34 in the inlet 40 in a stretched condition. Finally, the legs 36 are also drawn into the head 4.

I claim:

1. Apparatus for removing wrinkles from pantyhose portion surrounding a crotch area to which a gusset is applied, the pantyhose having a pair of leg portions and a panty portion, comprising:

edge stretching means for stretching the edge portion of the pantyhose surrounding said crotch area;

guide means for receiving the pantyhose from a feeding mechanism and transferring the pantyhose to the edge stretching means;

said edge stretching means including receiving means for receiving the pantyhose and means for holding the leg portions in a fixed position, movable means associated with said receiving means for moving the panty portion towards a hollow head associated with a gusset sewing machine for moving the panty portion into said hollow head;

said receiving means including a single vertical tube aligned with said hollow head for receiving both of said legs portions of said pair of leg portions; and suction means cooperating with said holding means for maintaining the pantyhose portion surrounding the crotch area stretched on said hollow head.

2. Apparatus as claimed in claim 1, wherein said single tube is coaxially aligned with said hollow head.

3. Apparatus as claimed in claim 1, wherein said single tube is vertically movable towards said head, and said movable means includes an internal sleeve movable within said tube and projectable outwardly therefrom for movement into the inlet of said hollow head for filling in and holding the interposed fabric of the pantyhose in said hollow head.

4. Apparatus as claimed in claim 1, wherein said guide means includes a basket positioned to a side of said means for holding the leg portions in a fixed position and positionable means operated in an alternating horizontal motion to guide the leg portions into said leg portions holding means.

5. Apparatus as claimed in claim 4, said positionable means being a sickle-shaped lever located on top of said basket.

6. Apparatus as claimed in claim 4, wherein said basket has an open top and a V-shaped plan profile having an open front portion.

7. Apparatus as claimed in claim 6, wherein said basket has a pair of fingers between which the leg portions are picked up and fed to the inlet of said receiving means.

8. Apparatus as claimed in claim 1, wherein:

said means for holding the leg portions in a fixed position includes pneumatic suction means for drawing the leg portions into said single vertical tube and pincer means for holding the leg portions in said single vertical tube.

9. Apparatus as claimed in claim 8, wherein said movable means includes an internal sleeve movable internally of said vertical tube; and said edge stretching means including a port on said vertical tube which is uncovered when said internal sleeve is raised to aid said suction means in the suction withdrawal of the leg portions from said tube and into the hollow head.

10. Apparatus as claimed in claim 8, wherein said moving means includes an interchangeable sleeve adapted to project from said receiving means and reduce the area thereof while at the same time increasing the velocity of air drawn into said receiving means by said suction means and to project into an inlet of said hollow head thereby filling therein interposed fabric and holding thereof.

11. Apparatus as claimed in claim 10, wherein said suction means cooperates with said receiving means for drawing thereinto the panty portion and the leg portions initially.

12. Apparatus as claimed in claim 11, wherein said means holding the leg portions in a fixed position includes pincer means, and said suction means includes suction for drawing the panty portion into said hollow head while the legs are held by said pincer means.

13. Apparatus as claimed in claim 12, said movable means including an internal sleeve movable towards said hollow head to cooperate with said suction means for drawing the panty portion into said hollow head.

14. Apparatus as claimed in claim 13, including port means cooperating with said suction means and said sleeve for drawing the leg portions into said hollow head.

15. A method for removing wrinkles from a pantyhose portion surrounding a crotch area to which a gusset is applied, the pantyhose having a pair of leg portions and a panty portion, comprising the steps of:

transferring the pantyhose from a feeding mechanism to a hollow head of a gusset sewing machine with the pantyhose body and leg portions in a loose hanging condition;

collecting with the aid of suction, the legs of the pantyhose in a single tube which is vertically placed under the head of a gusset sewing machine;

moving the tube in a vertical direction towards the head coaxially aligned therewith until it touches the head;

stretching the edge portion of the pantyhose surrounding the crotch area;

filling and holding in the hollow head the interposed fabric; and drawing the panty portion and the legs of the pantyhose into the hollow head.

16. The method of claim 15, including increasing the effective suction when drawing the legs from the vertical tube into the hollow head by providing for the ingress of air into the vertical tube through a port provided on the periphery thereof.

17. The method of claim 15, including guiding the legs of the pantyhose from the vertical tube into the hollow head while the pantyhose is hanging from the feeding mechanism.

18. The method of claim 15, wherein the panty of the pantyhose is hung from the head of gusset sewing machine prior to collecting the leg portions into the vertical tube.

19. The method of claim 15, wherein the leg portions and the panty portion are collected in a sleeve in said tube and suctionally drawn thereinto.

20. Apparatus for removing wrinkles from a pantyhose portion surrounding a crotch area to which a gusset is applied, the pantyhose having a pair of leg portions and a panty portion, comprising:

edge stretching means for stretching the edge portion of the pantyhose surrounding said crotch area;

guide means for receiving the pantyhose from a feeding mechanism and transferring the pantyhose to the edge stretching means;

said edge stretching means including receiving means for receiving the pantyhose and means for holding the leg portions in a fixed position, movable means associated with said receiving means for moving the panty portion towards a hollow head associated with a gusset sewing machine for moving the panty portion into said hollow head; and suction means cooperating with said holding means for maintaining the pantyhose portion surrounding the crotch area stretched on said hollow head;

said guide means including a basket positioned to a side of said means for holding the leg portions in a fixed position and positionable means operated in an alternating horizontal motion to guide the leg portions into said leg portions holding means.

* * * * *